US006332220B1

(12) United States Patent
Mai

(10) Patent No.: US 6,332,220 B1
(45) Date of Patent: Dec. 25, 2001

(54) COMBINED PACK FOR STORING TOOLS AND APRON

(76) Inventor: Hsiao-feng Mai, No. 17 Chuan-Yuan Street, Taichung City (TW)

( * ) Notice: Subject to any disclaimer, the term of this patent is extended or adjusted under 35 U.S.C. 154(b) by 0 days.

(21) Appl. No.: 09/895,251

(22) Filed: Jul. 2, 2001

(51) Int. Cl.[7] ..... A41B 13/10
(52) U.S. Cl. ..... 2/51; 224/904; 383/4
(58) Field of Search ..... 2/48, 49.1, 49.2, 2/50, 51, 463; 224/904; 383/4

(56) References Cited

U.S. PATENT DOCUMENTS 1,675,072 * 6/1928 Watermon ..... 2/51
2,315,095 * 3/1943 Rhodes ..... 224/5
2,846,685 * 8/1958 Ehrich ..... 2/51
4,461,332 * 7/1984 Parkhurst ..... 150/34
4,483,469 * 11/1984 Arisland ..... 224/151
4,880,315 * 11/1989 Berry et al. ..... 383/39
5,566,391 * 10/1996 Williamson ..... 2/51
5,656,020 * 8/1997 Greengarg ..... 602/19
6,193,118 * 2/2001 Kearl ..... 224/153

* cited by examiner

*Primary Examiner*—Gloria M. Hale
*Assistant Examiner*—Tejash Patel
(74) *Attorney, Agent, or Firm*—Rosenberg, Klein & Lee

(57) ABSTRACT

A combined pack for storing tools and apron is disclosed. It comprises a hand held outer layer, an apron inner layer, and at least one tool box. The first connecting portions and the second connecting portions are disposed on the hand held outer layer. The third connecting portions and the fourth connecting portions are disposed on the apron inner layer. So, the hand held outer layer, apron inner layer and the tool box (or two of them) can be combined together as one single pack. It not only is easy to carry, but also can save space. In addition, it is suitable to store unpacked tools, thinner tool box(s) or a thicker tool box. This invention's application scope is wide.

5 Claims, 5 Drawing Sheets

COMBINED PACK FOR STORING TOOLS AND APRON

BACKGROUND OF INVENTION

1. Field of the Invention

This invention relates to a combined pack for storing tools and apron, especially to a combined pack containing a hand held outer layer, an apron inner layer and a tool box (or tow of them) as one combined pack. It is easy to carry, saves space and is suitable for tool box(es).

2. Description of the Prior Art

The conventional hand held pack for storing tools is shown in FIGS. 1 and 2. It comprises a handle 91, an outer casing 92 and several foldable inner layers 93. The handle 91 is secured on an outer surface of the outer casing 92. Several storing pockets 95 for storing tools 94 are disposed on the inner layers 93. At the opening of each pocket 95, there is a zipper or snap-fastening buttons to prevent the stored tool(s) 94 sliding out. Besides, a plurality of adhesive fastening straps 921, 931 are disposed on pre-determined positions of the inner side of the outer casing 92 or of the inner layers 93. Therefore, after it is folded, it can be locked.

When a user wants to use it, the inner layers 93 should be opened and then the needed tools 94 (like screwdrivers, wrenches, pliers, etc.) can be put in. After which, the inner layers 93 are folded up and the corresponding adhesive fastening straps 921, 931 can be secured so as to form an integral one. As shown in FIG. 1, it is easy to carry.

However, in order to keep the user's dress clean, the user must bring an apron to avoid his/her dress getting dirty. It is quite inconvenient. In addition, may persons usually will forget to bring such an apron. So, the oil or dust at the working place might dirty the user's dress. Therefore, it is necessary to find out a good way to overcome this problem.

Furthermore, the thinner tool box might be inserted into the pockets 95, but it is impossible to insert a thicker full-set tool box in. So, if someone can invent a new product which can combine both apron and thicker tool box, it will be more convenient for people.

SUMMARY OF THE INVENTION

The primary object of this invention is to provide a combined pack for storing tools and apron. In which, the apron inner layer can be folded and secured in the hand held outer layer so that it is easy to carry an apron.

The other object of this invention is to provide a combined pack for storing tools and apron. In which, the total volume of the combined pack is small so as to save space.

Another object of this invention is to provide a combined pack for storing tools and apron that is suitable for thinner tool box(es) or thicker tool box. Thus, the application scope of this invention is wide.

DETAILED DESCRIPTION OF THE PREFERRED EMBODIMENT

Figure 1:
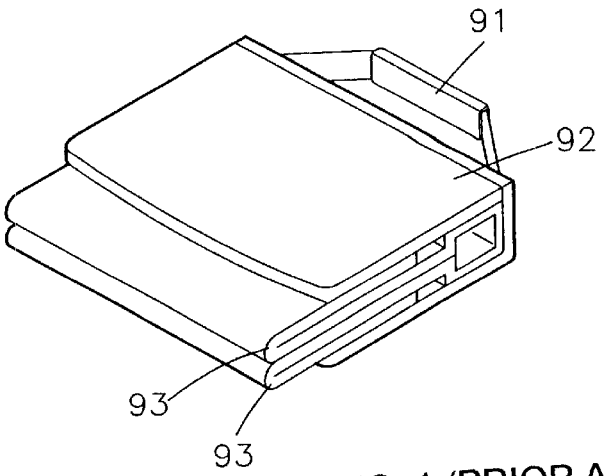
FIG. 1 (PRIOR ART)
FIG. 1 is a perspective view of a conventional hand held pack for storing tools in a folded condition.
Figure 2:
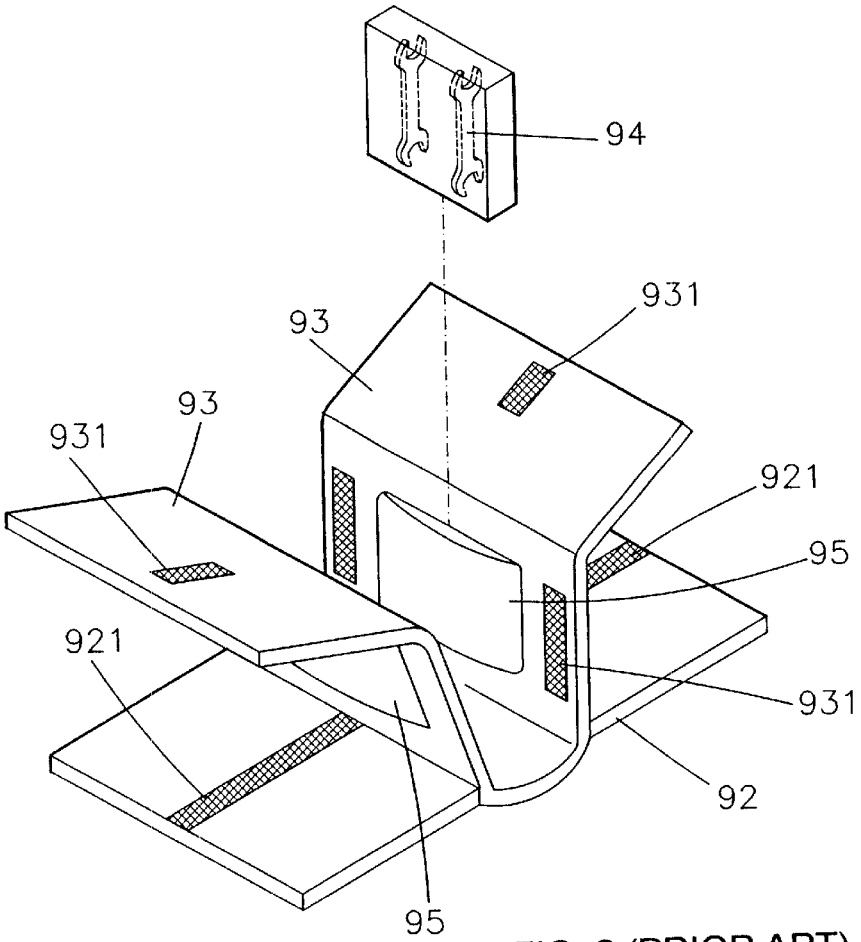
FIG. 2 (PRIOR ART)
FIG. 2 is a perspective view of a conventional hand held pack for storing tools in an unfolded condition.
Figure 3:
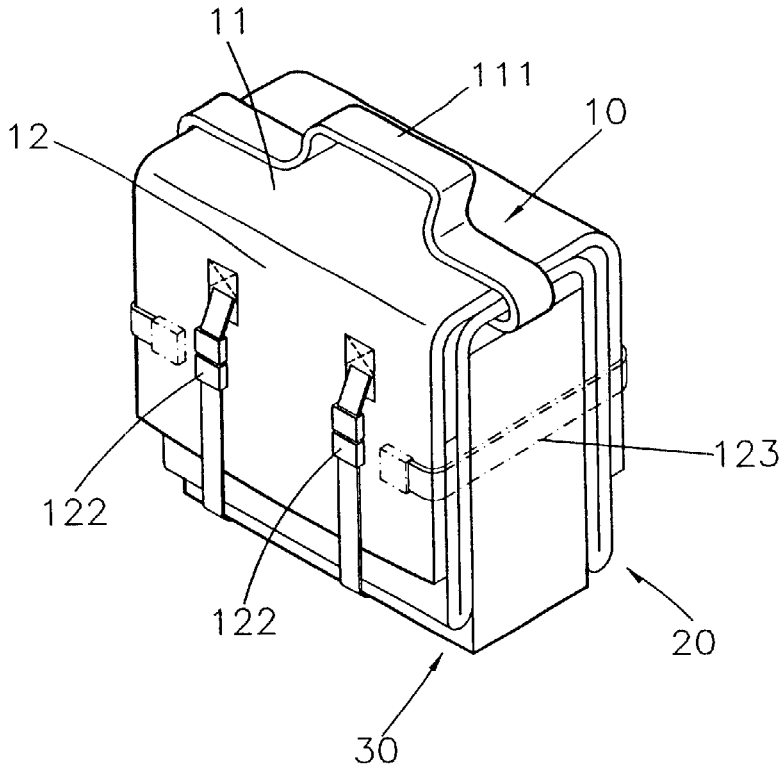
FIG. 3 is an assembled perspective view of the first embodiment of this invention.
Figure 4:
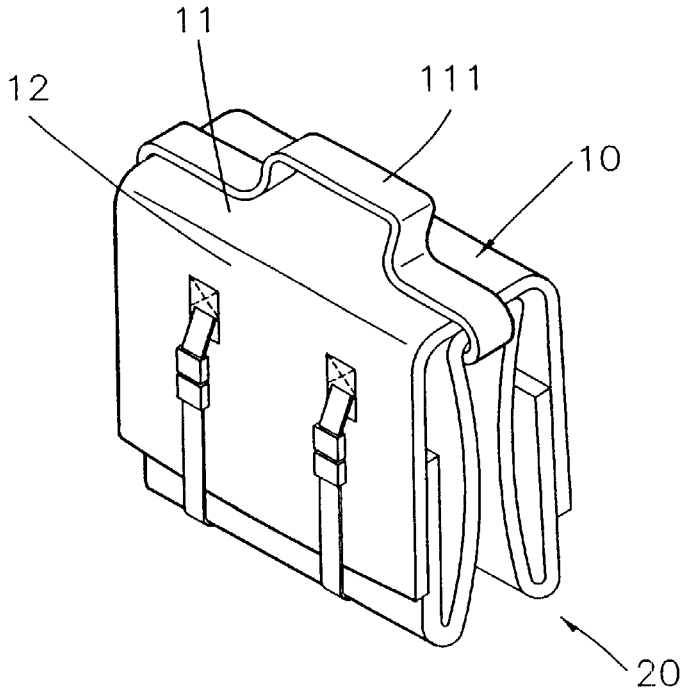
FIG. 4 is an assembled perspective view of the second embodiment of this invention.

Referring to FIGS. 3 and 4, this invention is a combined pack for storing tools and apron. It mainly comprises a hand held outer layer 10, an apron inner layer 20, and at least one tool box 30.

The hand held outer layer 10 has a central rectangular section 11, a pair of foldable covering sections 12 extending from the central rectangular section 11 and a pair of first connecting portions 13. A handle 111 is disposed on an outer surface of the central rectangular section 11. Each of the covering sections 12 has a second connecting portion 121 that is approximately centrally located in an inner surface of the covering section 12. These covering sections 12 have a pair of fastening straps 122 for securing the hand held outer layer 10.

The apron inner layer 20 is foldable. This apron inner layer 20 can be unfolded into an apron for a user to wear on. The apron inner layer 20 has a neck strap 21, two waist straps 22, a main apron portion 23 and two lateral apron portions 24 extending from a left side and right side of the main apron portion 23. The lateral apron portions 24 can store several small tools 25 (such as screwdriver, wrench, pliers, etc.). The lateral apron portions 24 can be folded inside on an inner surface of the main apron portion 23. An outer surface of the main apron portion 23 is divided into a central area 231 and several foldable portions 232. Two sides of the central area 231 are disposed with a pair of third connecting portions 233 corresponding to the first connecting portions 131. The foldable portions 232 have several fourth connecting portions 234 corresponding to the second connecting portions 121 so as to allow the corresponding second connecting portions 121 and the fourth connecting portions 234 to be connected and secured together.

In addition, a chest pocket 235 can be set on the upper portion of the main apron portion 23. So it is very convenient for the user to temporarily store some tools 25 in.

The tool box 30 (or several tool boxes 30) can be wrapped or sandwiched by the apron inner layer 20. This tool box 30 can be a typical plastic rectangular box having a full set of tools. Of course, the size of this tool box 30 should match with the size of the folded apron inner layer 20, so that they can be inserted and secured inside.

As shown in FIG. 3, the pair of the fastening straps 122 can be wound around the opening of the folded hand held outer layer 10. Therefore, it can prevent the enclosed apron inner layer 20 and the tool box 30 dropping down. Of course, in order to avoid the tool box 30 sliding out laterally, a pair of auxiliary fastening straps 123 (shown in the phantom line) or rope can be installed.

However, the above-mentioned first connecting portions 13, second connecting portions 121, third connecting portions 233, and fourth connecting portions 234 can be used from the common adhesive fastening elements (like the one used in shoes, bag or purse), snap-fastening buttons or other equivalent elements.

Referring to FIG. 4, it shows the second embodiment of this invention. In which, there are only the hand held outer layer 10 and the apron inner layer 20. The tool box 30 is excluded.

In a practical use, the first embodiment is described below as an example. At the beginning, as shown in FIG. 3, after the fastening strap 122 (and auxiliary fastening strap 123 ) is detached (or separated), the tool box 30 can be drawn out. Then, the first connecting portions 13 of the hand held outer layer 10 and the third connecting portions 233 of apron inner layer 20 can be separated. At this moment, the hand held outer layer 10 and the apron inner layer 20 are separated and become a condition shown in FIG. 5.

Figure 6:
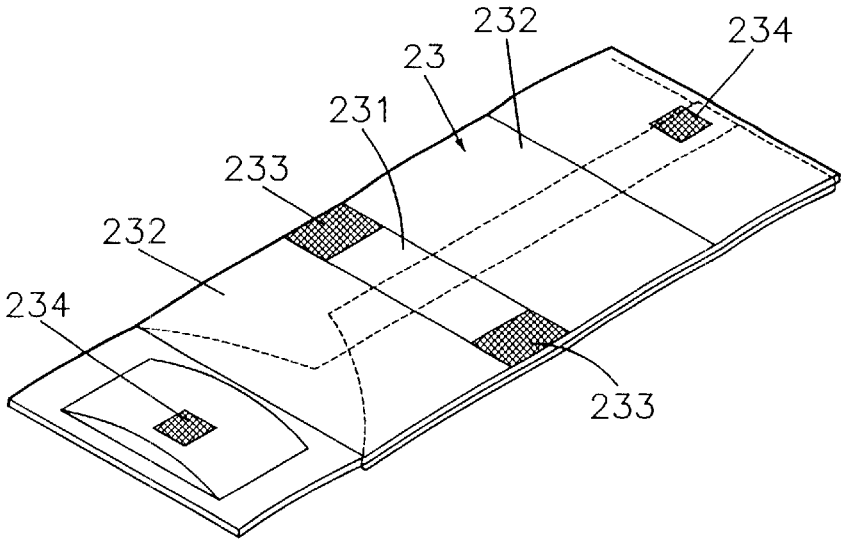
FIG. 6 shows the apron inner layer of this invention in a partially unfolded condition.
Figure 7:
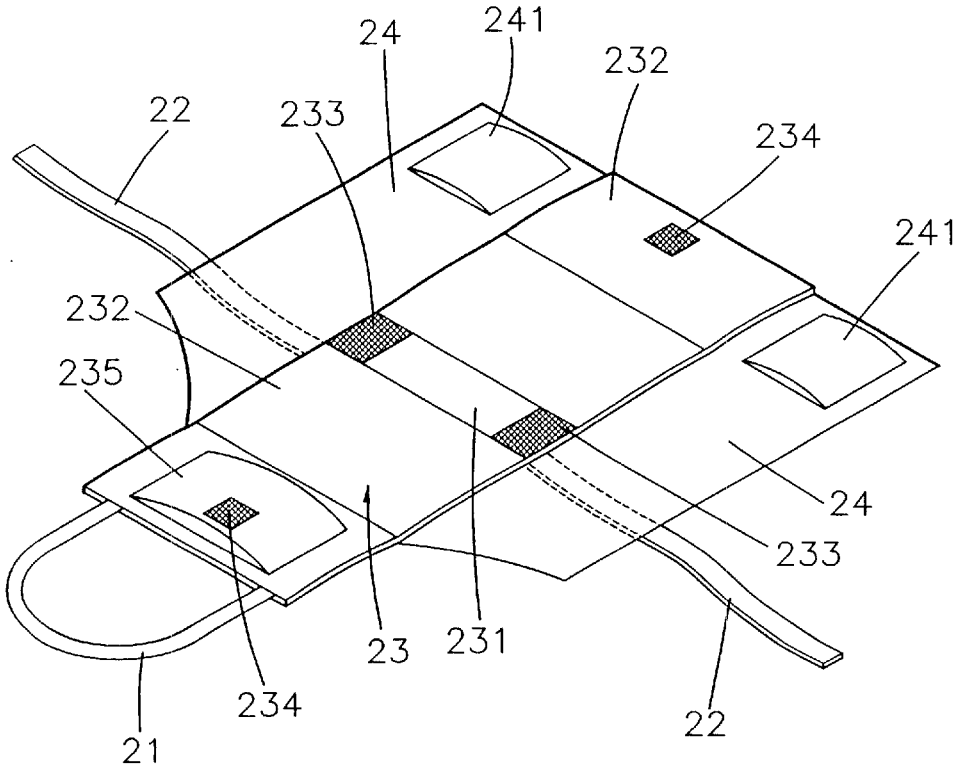
FIG. 7 shows the apron inner layer of this invention in a fully unfolded condition.
Figure 8:
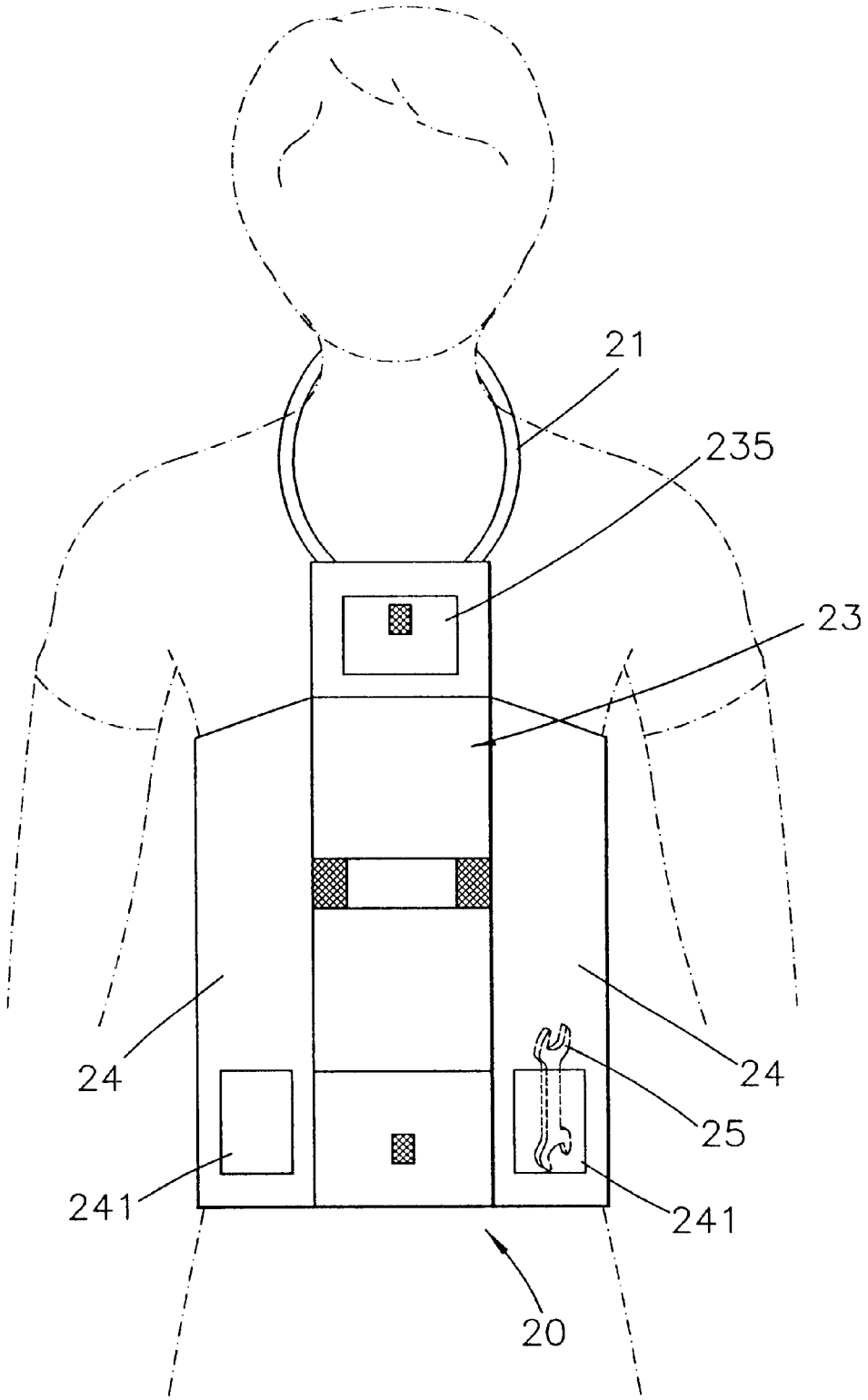
FIG. 8 illustrates a user wears on the apron inner layer.

Referring to FIG. 6, it illustrates the temporary condition after the apron inner layer 20 is unfolded. If these two lateral apron portions 24 are fully extended, it will form an apron shown in FIG. 7. At last, the neck strap 21 can be hung on the neck of the user and the waist straps 22 can be connected near the back of the user. Of course, several pockets 241 and the chest pocket 235 are disposed on desired position for conveniently storing tools.

Thus, after the user wears on the apron inner layer 20, the original dress is covered by this apron inner layer 20 and kept clean. Also, at least one tool box 30 containing several tools 25 (no matter screwdrivers, wrenches, pliers etc.) can be inserted in the folded apron inner layer 20.

Figure 5:
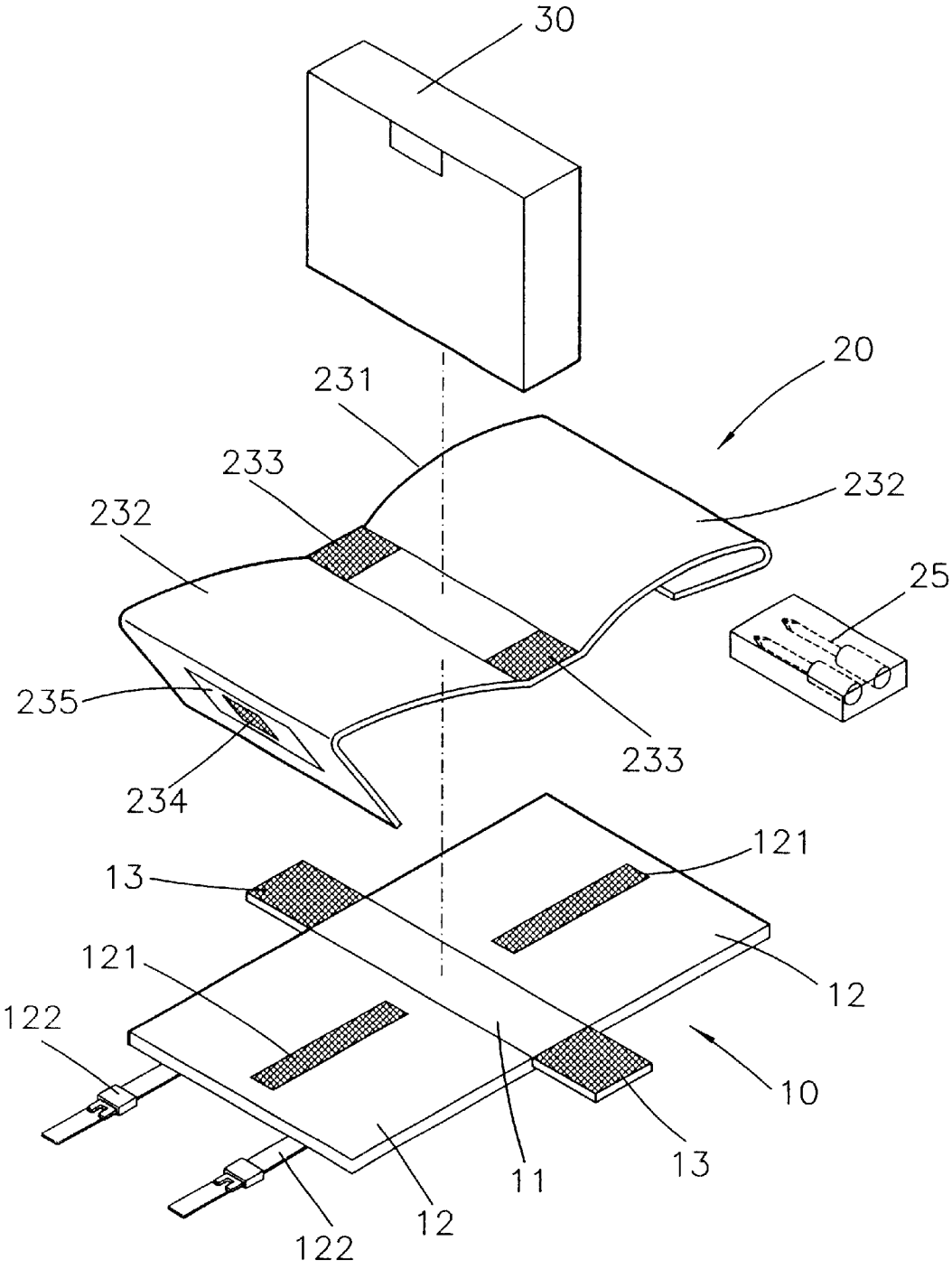
FIG. 5 is an exploded view of the first embodiment of this invention.

After a work is done, the user can put off the apron inner layer 20 first. Then, the two lateral apron portions 24 can be folded inside to overlap on inner surface of the main apron portion 23. As shown in FIG. 6, the tools 25 are put into the tool box 30. Finally, as shown in FIG. 5, the hand held outer layer 10 and the apron inner layer 20 can be attached together. The tool box 30 is inserted (be sandwiched) and become the condition shown in FIG. 3. That is, it forms a combined pack of the tools and the apron Actually, the tool box 30 is optional. If there is no such tool box 30, it becomes the condition shown in FIG. 4. This invention still works.

In this invention, the overall advantages and functions can be summarized as follows:

(1) It is easy to carry. Because the folded apron (the apron inner layer 20) and the tool box 30 can be secured within the hand held outer layer 10, this invention has the function of"easy to carry".

(2) It saves space. This invention can combine the hand held outer layer 10, apron inner layer 20 and the tool box 30 (or two of them) into an integral single pack with small size. Thus, its saves space.

(3) It is suitable for the unpacked tools, thinner tool boxes or the thicker full-set tool box. One or more thinner tool boxes or the thicker full-set tool box can be inserted and combined. Unpacked tools can be inserted in some pockets. No matter under which condition, this invention is suitable.

The above embodiments are only used to illustrate the present invention, not intended to limit the scope thereof. Many modifications of the above embodiments can be made without departing from the spirit of the present invention.

What is claimed is:

1. A combined pack for storing tools and apron comprising:

a hand held outer layer having a central rectangular section, a pair of foldable covering sections extending from said central rectangular section and a pair of first connecting portions, a handle being disposed on an outer surface of said central rectangular section, each of said covering sections having a second connecting portion which is approximately centrally located in an inner surface of said covering section, said covering sections having a pair of fastening straps for securing said hand held outer layer; and an apron inner layer being foldable, said apron inner layer being unfolded into an apron for a user to wear on, said apron inner layer having a neck strap, two waist straps, a main apron portion and two lateral apron portions extending from a left side and right side of said main apron portion, said lateral apron portions being folded inside on an inner surface of said main apron portion, an outer surface of said main apron portion being divided into a central area and several foldable portions, two sides of said central area being disposed with a pair of third connecting portions corresponding to said first connecting portions, said foldable portions having several fourth connecting portions securely connected to said second connecting portions.

2. A combined pack for storing tools and apron as claimed in claim 1, further comprising:

at least one tool box which is wrapped by said apron inner layer.

3. A combined pack for storing tools and apron as claimed in claim 1, wherein said first, second, third and fourth connecting portions are adhesive fastening elements.

4. A combined pack for storing tools and apron as claimed in claim 1, wherein said first, second, third and fourth connecting portions are snap-fastening buttons.

5. A combined pack for storing tools and apron as claimed in claim 1, wherein said hand held outer layer has a pair of auxiliary fastening straps.

* * * * *